US011311109B2

(12) United States Patent
Leng

(10) Patent No.: US 11,311,109 B2
(45) Date of Patent: Apr. 26, 2022

(54) REINFORCED BED FRAME

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 141 days.

(21) Appl. No.: 16/747,644

(22) Filed: Jan. 21, 2020

(65) Prior Publication Data

US 2020/0146460 A1 May 14, 2020

Related U.S. Application Data

(63) Continuation of application No. PCT/CN2018/097658, filed on Jul. 27, 2018.

(30) Foreign Application Priority Data

Jul. 31, 2017 (CN) ..... 201720941080.X

(51) Int. Cl.
*A47C 19/02* (2006.01)

(52) U.S. Cl.
CPC ..... *A47C 19/025* (2013.01)

(58) Field of Classification Search
CPC ..... A47C 19/025; A47C 19/027; A47C 19/20; A47C 19/028; A47C 19/021; F16B 12/54; F16B 12/56; F16B 2/02; F16B 7/042; F16L 23/22; F16L 47/14
See application file for complete search history.

(56) References Cited

U.S. PATENT DOCUMENTS 1,449,747 A * 3/1923 Fuchs ..... A47C 19/025 5/208
2,663,030 A 12/1953 Rudolf
6,185,791 B1 * 2/2001 Khokhar ..... B65D 63/1063 24/16 PB
2004/0078896 A1 * 4/2004 Hellyer ..... A47C 19/021 5/400

(Continued)

FOREIGN PATENT DOCUMENTS

CN 2143436 Y 10/1993
CN 201208084 Y 3/2009

(Continued)

OTHER PUBLICATIONS

International Search Report and Written Opinion with English Translation of ISR, cited in PCT/CN2018/097658 dated Oct. 24, 2018, 9 pages.

*Primary Examiner* — Robert G Santos
*Assistant Examiner* — Alison N Labarge
(74) *Attorney, Agent, or Firm* — Cooper Legal Group, LLC

(57) ABSTRACT

The present disclosure discloses a reinforced bed frame. The reinforced bed frame comprises a plurality of bed poles, two cross poles, at least one connecting member, and a plurality of movable buckles. Each of the at least one connecting member comprises a body and at least two fixing buckles connected to the body. Each of the plurality of movable buckles is configured to cover an opening of a corresponding one of the at least two fixing buckles and cooperate with the corresponding one of the at least two fixing buckles to surround a corresponding one of the plurality of bed poles.

8 Claims, 6 Drawing Sheets

(56) References Cited

U.S. PATENT DOCUMENTS

| | | | | |
|---|---|---|---|---|
| 2005/0123344 | A1* | 6/2005 | Bensussan | F16B 7/042 403/109.2 |
| 2009/0208277 | A1* | 8/2009 | Werth | F16L 23/08 403/312 |
| 2010/0132165 | A1* | 6/2010 | Shor | F16L 37/1225 24/19 |
| 2014/0028329 | A1 | 9/2014 | Nennie et al. | |
| 2014/0283298 | A1 | 9/2014 | Cheng | |
| 2015/0250325 | A1* | 9/2015 | Lee | A47C 19/12 5/202 |

FOREIGN PATENT DOCUMENTS

| | | | |
|---|---|---|---|
| CN | 201492084 | U | 6/2010 |
| CN | 201922932 | U | 8/2011 |
| CN | 206350615 | U | 7/2017 |
| IT | CH20100024 | A1 | 2/2011 |
| WO | 2003005860 | A1 | 1/2003 |

* cited by examiner

REINFORCED BED FRAME

RELATED APPLICATIONS

This application is a continuation of and claims priority to PCT Patent Application PCT/CN2018/097658, filed on Jul. 27, 2018, which claims priority to Chinese Patent Application 201720941080.X, filed on Jul. 31, 2017. PCT Patent Application PCT/CN2018/097658 and Chinese Patent Application 201720941080.X are incorporated herein by reference.

FIELD OF THE DISCLOSURE

The present disclosure relates to a pole frame bed, and in particular relates to a reinforcement of bed poles.

BACKGROUND OF THE DISCLOSURE

A pole frame bed can also be called an iron frame bed and can be a single-layer structure or a double-layer structure. A bed frame of the pole frame bed comprises two cross poles disposed on left and right sides and a plurality of bed poles arranged in parallel. Two ends of each of the plurality of bed poles are respectively connected to the two cross poles on the left and right sides.

Since the two ends of each of the plurality of bed poles are only connected to the two cross poles, there is no connection between adjacent bed poles, and a force of each of the plurality of bed poles needs to be separately supported by the two cross pole. When the bed frame bears a larger force, especially at a focus point, two adjacent bed poles of the plurality of bed poles are easily pushed away, resulting in obvious subsidence of the bed frame. Therefore, the existing bed frames have technical defects resulting in structural instability.

BRIEF SUMMARY OF THE DISCLOSURE

The present disclosure provides a reinforced bed frame to solve deficiencies of the existing techniques. The reinforced bed frame comprises a plurality of bed poles reinforced to each other. In order to solve the aforementioned technical problems, the present disclosure provides a reinforced bed frame.

A reinforced bed frame comprises a plurality of bed poles arranged in parallel, two cross poles, at least one connecting member, and a plurality of movable buckles. Two ends of each of the plurality of bed poles are respectively connected to the two cross poles. Each of the at least one connecting member comprises a body and at least two fixing buckles connected to the body. Each of the at least two fixing buckles and each of the plurality of movable buckles are C-shaped. Two of the at least two fixing buckles are respectively locked to a first bed pole of the plurality of bed poles and a second bed pole of the plurality of bed poles. The second bed pole is adjacent to the first bed pole. Each of the plurality of movable buckles is configured to cover an opening of a corresponding one of the at least two fixing buckles and cooperate with the corresponding one of the at least two fixing buckles to surround a corresponding one of the plurality of bed poles. Each of the at least two fixing buckles corresponds to a corresponding one of the plurality of movable buckles. A fastener structure is configured to be locked together and to be unlocked between each of the at least two fixing buckles and the corresponding one of the plurality of movable buckles.

In another preferred embodiment, an inner surface of each of the at least two fixing buckles is disposed with an insertion pin, the corresponding one of the plurality of bed poles is disposed with an insertion hole, and the insertion pin is disposed in the insertion hole.

In another preferred embodiment, an inner surface of each of the plurality of movable buckles is disposed with an insertion pin, the corresponding one of the plurality of bed poles is disposed with an insertion hole, and the insertion pin is disposed in the insertion hole.

In another preferred embodiment, each of the plurality of movable buckles is movably coupled to the corresponding one of the at least two fixing buckles.

In another preferred embodiment, the at least one connecting member is a plastic element, each of the plurality of movable buckles and a corresponding one of the at least one connecting member is integrally molded, and each of the plurality of movable buckles and the corresponding one of the at least one connecting member are connected by a rib.

In another preferred embodiment, the fastener structure comprises a hook disposed on each of the plurality of movable buckles and a lock hole disposed on a corresponding one of the body.

In another preferred embodiment, a length of the body corresponds to a space between the first bed pole and the second bed pole, the at least two fixing buckles comprises two fixing buckles, and the two fixing buckles are respectively symmetrically disposed on both ends of a corresponding one of the body.

In another preferred embodiment, the plurality of bed poles are disposed at intervals.

In another preferred embodiment, each of the plurality of movable buckles and the corresponding one of the at least one connecting member is integrally injection molded.

Compared with existing techniques, the technical solution provided by the present disclosure has the following advantages.

First, the at least two fixing buckles of each of the plurality of connecting members can respectively fasten the first bed pole and the second bed pole, and then each of the plurality of movable buckles encloses an opening of a corresponding one of the at least two fixing buckles. Each of the plurality of movable buckles and the corresponding one of the at least two fixing buckles are coupled to define a round hole, thereby holding a corresponding one of the plurality of bed poles. Each of the plurality of connecting members can connect the first bed pole and the second bed pole together. Therefore, a loading capacity of the bed frame is greatly improved, and the bed frame is stabilized.

Second, the inner surface of each of the at least two fixing buckles is disposed with an insertion pin, and a corresponding one of the plurality of bed poles is disposed with an insertion hole. The insertion pin is inserted into the insertion hole. Therefore, the at least one connecting member can be positioned to improve an efficiency of assembly, a connection strength between each of the at least one connecting member and a corresponding one of the plurality of bed poles can be improved, and a stability of the bed frame can be further improved.

Third, each of the plurality of movable buckles is movably connected with a corresponding one of the at least two fixing buckles. Therefore, disassembly and assembly are convenient.

BRIEF DESCRIPTION OF THE DRAWING

The present disclosure will be further described below with the combination of the accompanying drawings together with the embodiments.

DETAILED DESCRIPTION OF THE EMBODIMENTS

Figure 1:
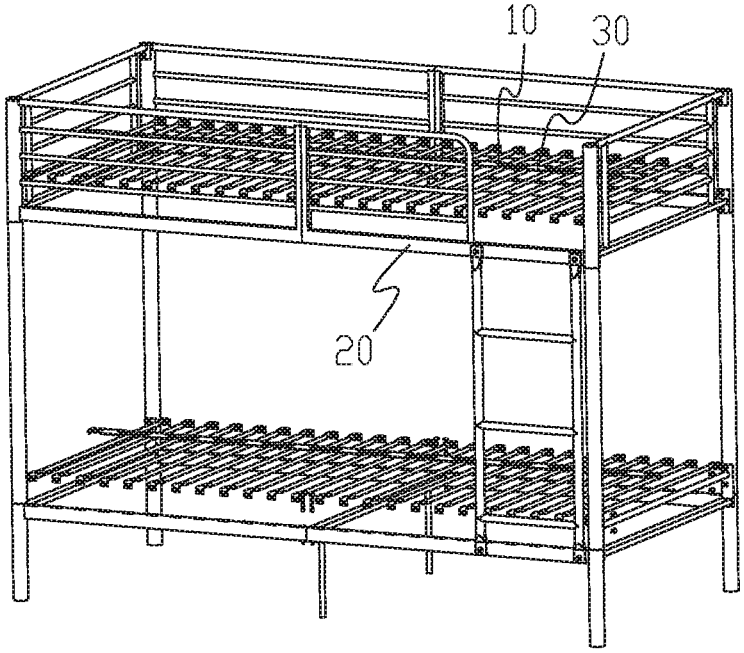
FIG. 1 illustrates an exploded perspective view of a reinforced bed frame of an embodiment of the present disclosure.
Figure 2:
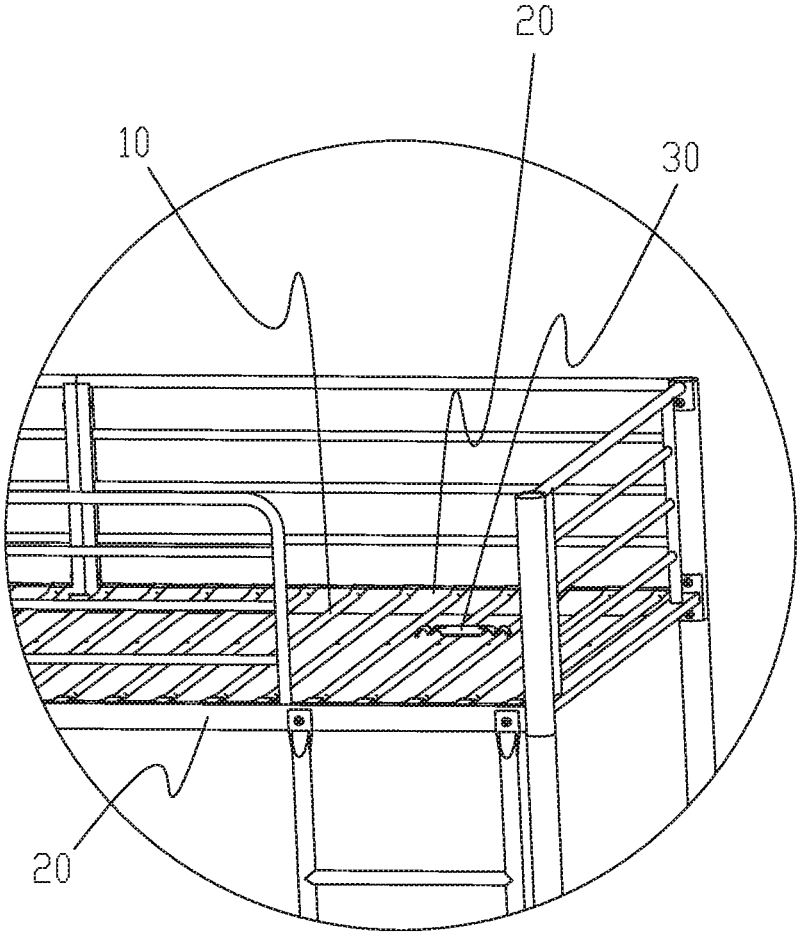
FIG. 2 illustrates an enlarged schematic view of a portion of the reinforced bed frame shown in FIG. 1.
Figure 3:
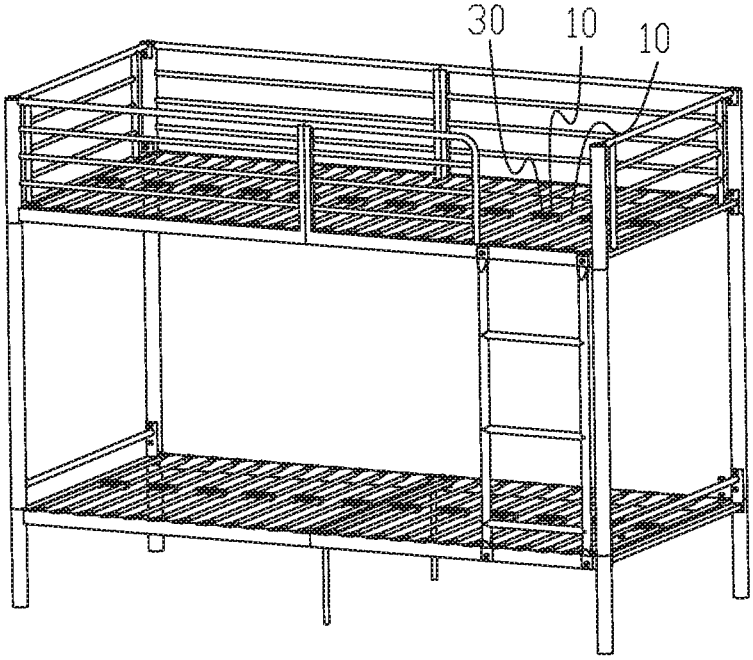
FIG. 3 illustrates a perspective view of the reinforced bed frame shown in FIG. 1.
Figure 4:
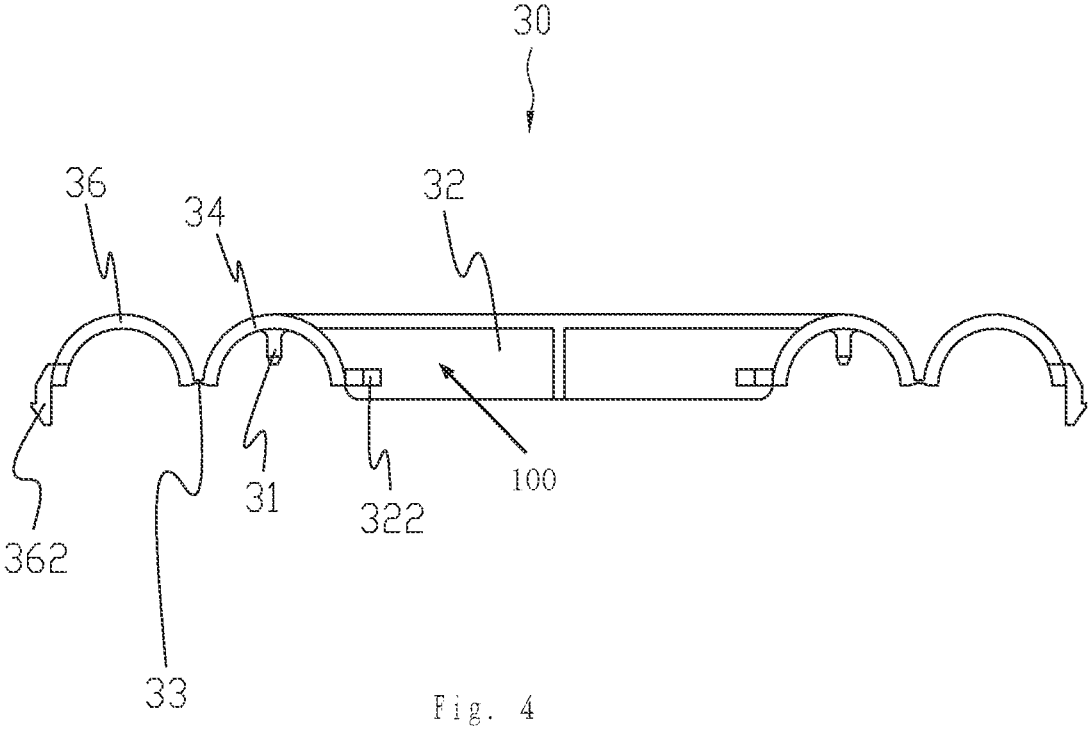
FIG. 4 illustrates a front view of a connecting member of the reinforced bed frame shown in FIG. 1.
Figure 5:
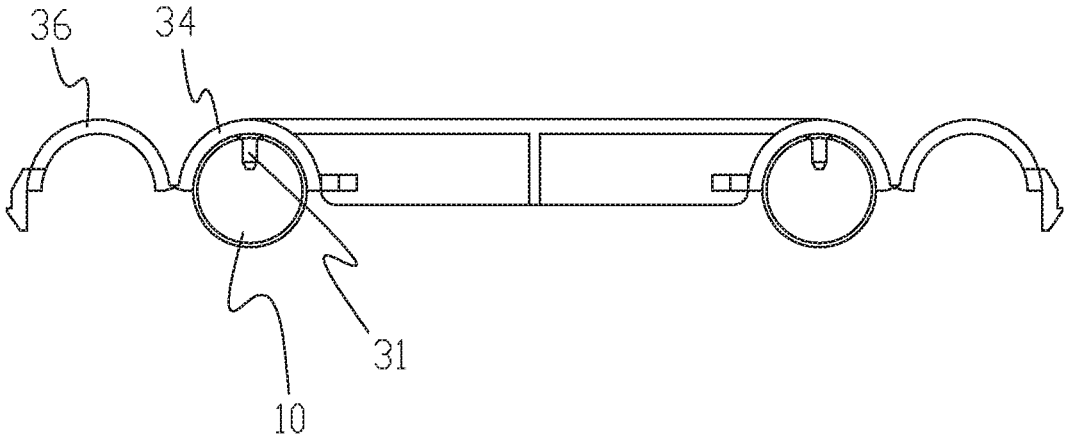
FIG. 5 illustrates a schematic view of a bed pole being locked through a C-shaped fixing buckle of the connecting member of FIG. 4.
Figure 6:
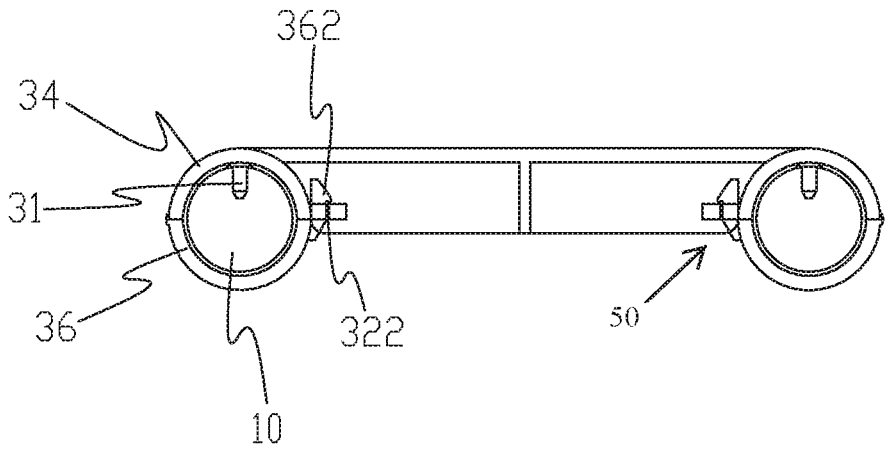
FIG. 6 illustrates a schematic view of the bed pole being locked through cooperation of the C-shaped fixing buckle and a C-shaped movable buckle of the connecting member shown in FIG. 4.

Referring to FIG. 1 to FIG. 6, a reinforced bed frame of the present disclosure comprises a plurality of bed poles 10 arranged in parallel. Two ends of each of the plurality of bed poles 10 are respectively connected to two cross poles 20 of the reinforced bed frame. The reinforced bed frame further comprises at least one connecting member 30 that comprises a body 32 and at least two fixing buckles 34 connected to the body 32. The at least two fixing buckles 34 are C-shaped. Two of the at least two fixing buckles 34 are respectively locked to a first bed pole of the plurality of bed poles 10 and a second bed pole of the plurality of bed poles 10, which is adjacent to the first bed pole. The reinforced bed frame further comprises a plurality of movable buckles 36. Each of the plurality of movable buckles 36 is configured to cover an opening of a corresponding one of the at least two fixing buckles 34 and cooperate with the corresponding one of the at least two fixing buckles 34 to surround a corresponding one of the plurality of bed poles 10. The movable buckle 36 is C-shaped, and each of the at least two fixing buckles 34 corresponds to a corresponding one of the plurality of movable buckles 36. A fastener structure 50 is configured to be locked together and to be unlocked between each of the at least two fixing buckles 34 and the corresponding one of the plurality of movable buckles 36.

An inner surface of each of the at least two fixing buckles 34 is disposed with an insertion pin 31. Each of the plurality of bed poles 10 is disposed with an insertion hole 12, and the insertion pin 31 is inserted into the insertion hole 12 so that positioning and installation is facilitated. A connection strength is also improved. Optionally, an insertion pin 31 can also be disposed on an inner surface of each of the plurality of movable buckles 36, and the corresponding one of the plurality of bed poles is disposed with an insertion hole for the insertion pin being inserted thereto.

Each of the plurality of movable buckles 36 is movably coupled to a corresponding one of the at least two fixing buckles 34. The at least one connecting member 30 is a plastic element. Each of the plurality of movable buckles 36 and a corresponding one of the at least one connecting member 30 are integrally molded. Each of the plurality of movable buckles 36 and a corresponding one of the at least two fixing buckles 34 are connected by a thin rib 33. The fastener structure 50 comprises a hook 362 disposed on each of the plurality of movable buckles 36 and a lock hole 322 disposed on a corresponding one of the body 32.

A length of the body 32 corresponds to a space between the first bed pole 10 and the second bed pole 10, and a number of the at least two fixing buckles 34 is two. Two of the at least two fixing buckles 34 are respectively symmetrically disposed on two ends of the body 32.

Optionally, each of the at least one connecting member 30 is disposed with at least two fixing buckles 34 to connect at least two bed poles of the plurality of bed poles 10 at one time. Or optionally, the reinforced bed frame comprises a plurality of connecting members 30.

Certainly, each of the plurality of movable buckles 36 is configured to open or close an opening of a corresponding one of the at least two fixing buckles 34 and a corresponding one of the plurality of bed poles 10. Each of the plurality of movable buckles 36 is separated from the corresponding one of the at least two fixing buckles 34, or each of the plurality of movable buckles 36 and the corresponding one of the at least two fixing buckles 34 are connected by hinges.

The body 32, the two of the at least two fixing buckles 34, and corresponding ones of the plurality of movable buckles 26 define a space 100, and the fastener structure 50 is received in the space 100.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A reinforced bed frame, comprising:

a plurality of bed poles arranged in parallel, two cross poles, at least one connecting member, and a plurality of movable buckles, wherein:

two ends of each of the plurality of bed poles are respectively connected to the two cross poles, each of the at least one connecting member comprises a body and at least two fixing buckles connected to the body, each of the at least two fixing buckles and each of the plurality of movable buckles are C-shaped, two of the at least two fixing buckles are respectively locked to a first bed pole of the plurality of bed poles and a second bed pole of the plurality of bed poles, the second bed pole is adjacent to the first bed pole, each of the plurality of movable buckles is configured to cover an opening of a corresponding one of the at least two fixing buckles and cooperate with the corresponding one of the at least two fixing buckles to surround a corresponding one of the plurality of bed poles, each of the at least two fixing buckles corresponds to a corresponding one of the plurality of movable buckles, a fastener structure configured to be locked together and to be unlocked is disposed between each of the at least two fixing buckles and the corresponding one of the plurality of movable buckles, the body, the two of the at least two fixing buckles, and corresponding ones of the plurality of movable buckles define a space, and the fastener structure is received in the space.

2. The reinforced bed frame according to claim 1, wherein:

an inner surface of each of the at least two fixing buckles is disposed with an insertion pin, the corresponding one of the plurality of bed poles is disposed with an insertion hole, and the insertion pin is disposed in the insertion hole.

3. The reinforced bed frame according to claim 1, wherein each of the plurality of movable buckles is movably coupled to the corresponding one of the at least two fixing buckles.

4. The reinforced bed frame according to claim 3, wherein:

the at least one connecting member is a plastic element, each of the plurality of movable buckles and a corresponding one of the at least one connecting member is integrally molded, and each of the plurality of movable buckles and the corresponding one of the at least one connecting member are connected by a rib.

5. The reinforced bed frame according to claim 4, wherein the fastener structure comprises a hook disposed on each of the plurality of movable buckles and a lock hole disposed on a corresponding one of the body.

6. The reinforced bed frame according to claim 4, wherein each of the plurality of movable buckles and the corresponding one of the at least one connecting member is integrally injection molded.

7. The reinforced bed frame according to claim 1, wherein:

a length of the body corresponds to a space between the first bed pole and the second bed pole, the at least two fixing buckles comprises two fixing buckles, and the two fixing buckles are respectively symmetrically disposed on both ends of a corresponding one of the body.

8. The reinforced bed frame according to claim 1, wherein the plurality of bed poles are disposed at intervals.

* * * * *